US005323132A

United States Patent [19]

Abot et al.

[11] Patent Number: 5,323,132

[45] Date of Patent: Jun. 21, 1994

[54] SWITCH DEVICE COMPRISING A MONOSTABLE AUXILIARY SWITCH COUPLED TO A MAIN SWITCH

[75] Inventors: Jean Abot, L'Isle Adam; Christian Lange, Fontenay Tresigny; Michel Ledroit, Yerres, all of France

[73] Assignee: Telemecanioue, France

[21] Appl. No.: 859,308

[22] PCT Filed: Sep. 26, 1991

[86] PCT No.: PCT/FR91/00748

§ 371 Date: May 27, 1992

§ 102(e) Date: May 27, 1992

[87] PCT Pub. No.: WO92/06483

PCT Pub. Date: Apr. 16, 1992

[30] Foreign Application Priority Data

Sep. 27, 1990 [FR] France ..... 90 11920

[51] Int. Cl.[5] ..... H01H 67/02

[52] U.S. Cl. ..... 335/132; 335/202

[58] Field of Search ..... 335/6, 8–10, 335/131, 132, 202

[56] References Cited

U.S. PATENT DOCUMENTS 4,281,305 7/1981 Weeks ..... 335/202

4,345,225 8/1982 Lemmer ..... 335/132

*Primary Examiner*—Lincoln Donovan

*Attorney, Agent, or Firm*—William A. Drucker

[57] ABSTRACT

A switch device using a main switch coupled to a monostable auxiliary switch through a releasable coupling is disclosed. In this device, the auxiliary switch and the main switch are closed in succession by simultaneous movement of their respective contact-holders and are opened in the reverse order by virtue of the presence of the releasable coupling which is released during closing and engaged during opening.

9 Claims, 2 Drawing Sheets

SWITCH DEVICE COMPRISING A MONOSTABLE AUXILIARY SWITCH COUPLED TO A MAIN SWITCH

Figure 1:
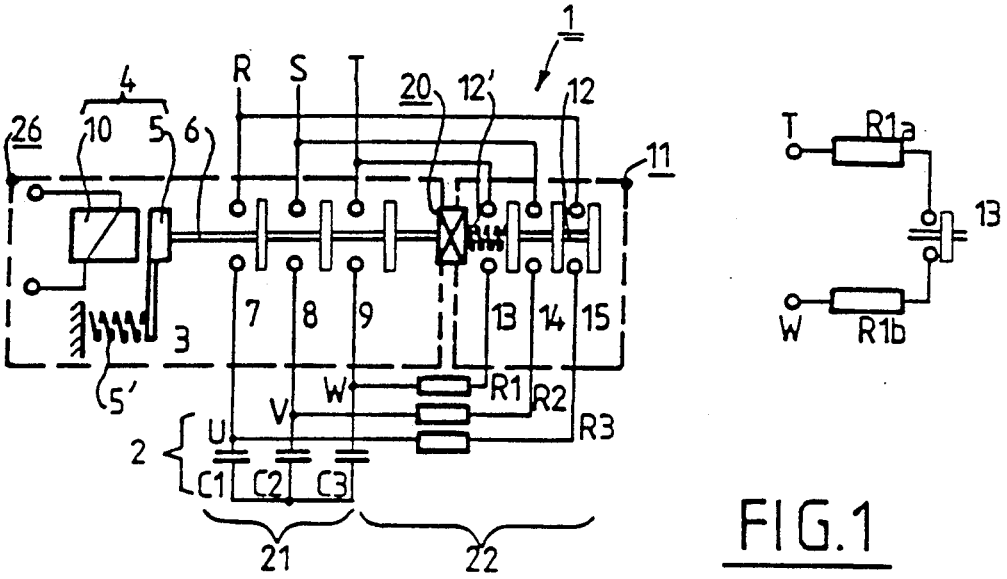

The present invention concerns a switch device comprising at least one main switch adapted to change state after a transient opening or closing phase due to the action of an operating member and at least one monostable secondary switch adapted to change state temporarily during one of said two transient states.

Generally speaking, it is suitable for all systems employing a switch where it is necessary to detect and possibly to signal the transient opening or closing phase.

It is particularly suitable for implementing multipole switch devices for supplying capacitive loads in which the load current is first established through limiter resistors connected in parallel with main switches that are still open by auxiliary switches connected in series with the resistors, the main switches being then closed by an operating member which closed the auxiliary switches.

These switch devices are used in particular in installations where it is required to improve the power factor. They may malfunction due to ageing of the contact members.

The operating sequence described above is usually obtained by using an operating member which is connected to a solenoid armature and actuates the moving parts of the switches simultaneously. Because of different size gaps between the moving contact parts and the respective fixed contact parts of the two sets of switches, the same movement first closes the auxiliary switches and then closes the main switches which therefore operate initially at a reduced current and thereafter at a constant current representing steady state conditions.

When the solenoid is de-energised to disconnect the capacitive load movement in the opposite direction is imparted to the operating member and the main switches open first and, because the auxiliary switches are still closed, interrupt a virtually negligible current. The auxiliary switches provide most of the rupture capacity and this compromises the service life of the device because their rating is less well suited to this function.

The fixed and moving parts of the main switches are never opened or closed at full load and so they do not benefit from the erosion caused by the electrical arcs and their contact surfaces are progressively polluted which results in an abnormal increase in the contact resistance and sometimes failure of the main poles to close. The increased resistance may in turn disrupt the thermal equilibrium of the switch device, and in particular that of the auxiliary switch and the resistors.

For this type of application, an object of the invention is to provide a switch device operating as described above on closing but reversing the sequence of actuation of the contact parts of the main and auxiliary switches on opening so that the current is transferred reliably from the auxiliary switches to the main switches.

To achieve these results, the invention proposes a switch device comprising at least one main switch adapted to change from an open condition to a closed condition during a transient closing phase and from a closed condition to an open condition during a transient opening phase, said two phases being caused by respective displacements of an operating member, and at least one auxiliary switch comprising at least one fixed contact and one mobile contact coupled to said operating member by a mechanical linkage.

According to the invention, this device is characterised in that said mechanical linkage comprises a releasable coupling adapted to change from a coupled condition to an uncoupled condition during one of said transient phases and to return thereafter from said uncoupled condition to said coupled condition during subsequent passage of the main switch through the other transient phase.

Advantageously, said releasable coupling is of the stress-release type and is adapted to be released when the operating force transmitted to the auxiliary switch by the operating member of the main switch exceeds a predetermined threshold.

In a first embodiment of the invention said releasable coupling comprises resilient snap-fastener means.

In a second embodiment intended to alleviate possible wear of surfaces rubbing together during frequent coupling and uncoupling the releasable coupling employs at least two parts mechanically coupled together.

Finally, in an arrangement which is beneficial in either of the above two embodiments, the auxiliary switch and the associated return spring are disposed in a casing independent of the body of a contactor device comprising the main switch, an armature return spring and the solenoid which is adapted to actuate both types of switch.

Figure 2:
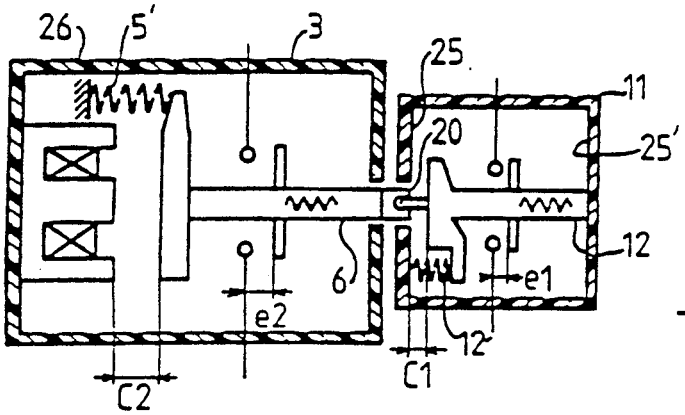
Figure 3:
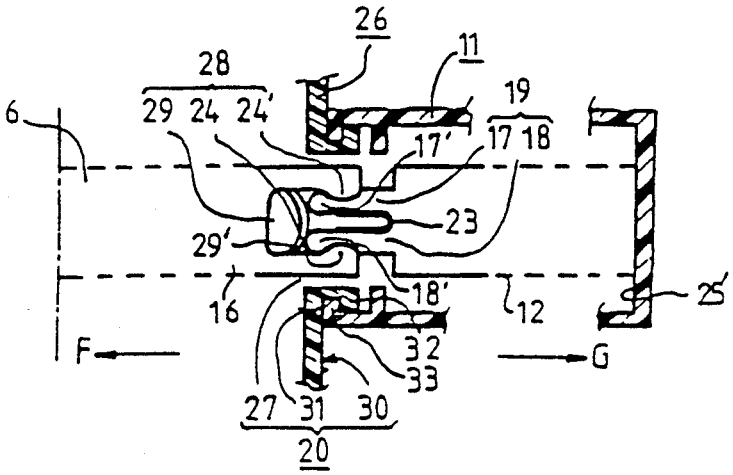
Figure 4:
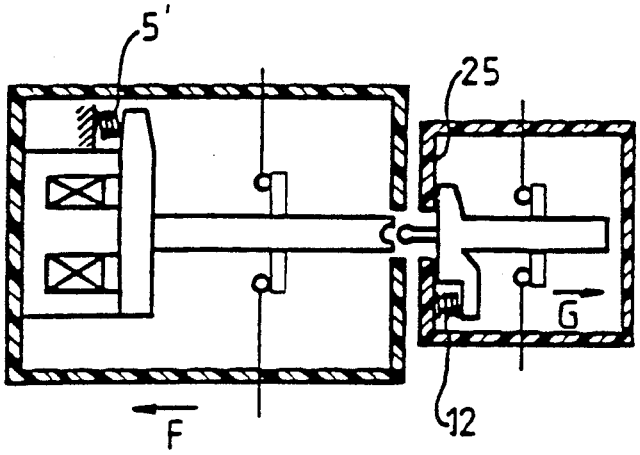
Figure 5:
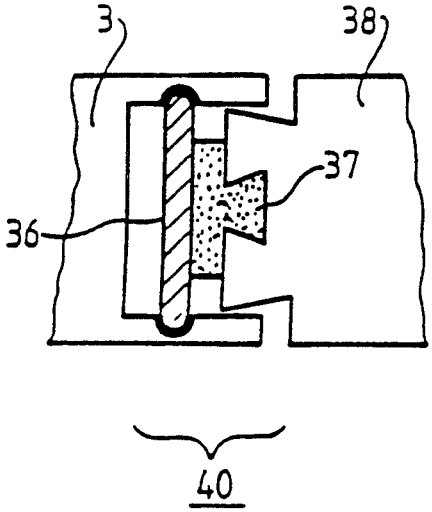

The invention and embodiments of it will be better understood from the following description and the appended figures showing:

In FIG. 1, an electric circuit diagram of a circuit for connecting a capacitive load to a three-phase AC mains power supply using a device in accordance with the invention;

In FIG. 2, a diagrammatic representation of the two switch systems when unoperated;

In FIG. 3, a mechanical first embodiment of a releasable coupling between two contact-holders aligned with each other;

In FIG. 4, a state of the switch device representing an operative phase in which the main switches are closed and the auxiliary switches are open; and In FIG. 5, a magnetic second embodiment of a releasable coupling between two aligned contact-holders.

A circuit 1 for connecting a capacitive load 2 comprising three capacitors C1, C2, C3 to a three-phase AC mains power supply R, S, T is shown in FIG. 1.

A remote controlled type device (shown in this figure by way of example only) to make this connection utilises an electromagnetic contactor device 3 comprising in a casing 26 a solenoid 4, a mobile armature 5, a return spring 5' which urges the latter into a rest position, and an operating member 6 which may advantageously be an insulative or contact-holder rake on which are disposed the moving parts of a set of three-pole main switches 7, 8, 9 and, in a casing 11 mechanically associated with the casing 26, a set of auxiliary switches 13, 14, 15 actuated by a second operating member 12 which may also be in the form of a rake or insulative contact-holder and is acted on by a return spring 12' which tends to open these switches.

The two operating members, which in this example are advantageously aligned with each other although this is not necessarily so, are coupled together by a releasable coupling 20 whose operation will be described later.

It must be understood that a contactor device is used in this example only with reference to a requirement for remote control and that manual operating means may be substituted for the solenoid in a device having the same mechanical and electrical function, possibly grouped together in a single casing or unit appropriate to this end; known mechanical means could in this case be disposed between a manual operating member and a contact-holder operating member in order to communicate sufficiently fast opening and closing movements to the latter.

The auxiliary switches 13, 14, 15 are in series with respective limiter resistors R1, R2, R3. Each of these series circuits is connected in parallel with a respective main switch 9, 8, 7.

Each resistor R1 may be divided into two series resistors R1*a*, R1*b* disposed one on each side of the respective auxiliary switch 13; the resistors which in this example are outside the casings 26, 11 are advantageously connected to the external terminals of the switches by their connecting leads so that heat is dissipated adequately and so that the manufacturer does not need to modify the conventional casings available to him to accommodate the contactor and the auxiliary contact unit (see FIG. 1).

In the unoperated condition of the device shown in this figure the main and auxiliary sets of contacts are held open by the return springs.

Because the contact-holder 6 and the contact-holder 12 are associated with each other by virtue of the coupling 20, which is engaged in the unoperated condition of the switch device, any movement of the former in the direction F causes simultaneous movement of the latter when the solenoid is energised.

To prevent high instantaneous load currents which would otherwise flow upon direct connection of the load to the AC mains power supply flowing in the main power circuit 21 comprising the main switches, reduced load currents are shunted into the auxiliary power circuit 22 when the solenoid is energised by closing the auxiliary switches beforehand.

They are closed a few milliseconds before the main switches because of the difference between the contact closing distances of the main switch contact parts (e2) and the smaller contact closing distances of the auxiliary switches (e1) and allow only reduced initial currents to flow through the three resistors.

The required result is achieved by careful choice of the travels of the two contact-holders, that (c1) of the auxiliary rake being made less than that c2 of the main contact-holder by the use of a mechanical abutment which retains the former while the latter continues to move (see FIG. 2).

This difference in the two travels is used to release automatically the coupling 20 and therefore the two contact-holders so that the auxiliary contact-holder is released and enabled to return to its unoperated position when the main contact-holder has already closed the respective switches.

To return the complete device to an unoperated condition identical to that before the solenoid is energised, the return of the main contact-holder to the unoperated position is caused to re-engage the coupling 20 quickly due to the action of its own return spring alone and so recouple the two contact-holders 6, 12.

A first type of releasable coupling 20 seen in FIG. 3 in the coupled condition when the complete switch device is in the unoperated condition uses simple mechanical means that can be moulded or overmoulded during manufacture or which can be provided by appropriately attached separate parts.

An extension 16 of the contact-holder 6 which passes through an opening 27 in the casing 26 of the contactor and projects from one side 30 of the latter (for example the front side or a lateral side) includes a recess 28 whose opposite edges 24, 24' are narrower at the inlet than the transverse dimension of a subsequent housing 29.

The contact-holder 12 of the auxiliary contact casing 11 has a forked extension 19 with elastic branches 17, 18 whose ends 17', 18' are wider than the preceding portion. The elasticity of this fork, which requires a stiffness that may make it necessary to employ an additional elastic metal part 23, enables it to be disengaged from the housing if sufficient longitudinal traction is exerted between the two contact-holders and enables it to be inserted in the latter when longitudinal thrust towards the contact-holder 12 is exerted by the contact-holder 6.

In the associated state of the two casings, which may be obtained by claws 32, 33 on the facing surfaces 30, 31, and in the unoperated condition of the contact-holders 6, 12, the return spring 12' pulls the latter back against an abutment 25' of the casing 11 with a relatively low force and the return spring 5' of the armature pulls the contact-holder 6 back in the same direction into its unoperated position.

When the contact-holder 6 moves in the direction F when the solenoid is energised, a first travel c1 of contact-holder 12 which compresses the spring 12' is required to close the switches 13, 14, 15 and to establish an appropriate contact pressure. This movement continues until the contact-holder 12 bears and stops against a first abutment surface 25 of the casing 11 (see FIG. 2).

Because the travel c2 of the main contact-holder is greater than c1, the fork 19 disengages itself from the housing 29 and the branches 24, 24' allowing the return spring 12' to move the contact-holder 12 in the direction G against the abutment 25'; it is clear that the releasing of the coupling 20 and the opening of the auxiliary switches resulting therefrom occur only when the main switches are themselves being closed and the contact pressure of their mobile parts has already reached an adequate value (see FIG. 4).

De-energisation of the solenoid of the contactor which enables the contact-holder 6 to be moved in the direction G towards its unoperated position by the return spring 5' brings the edges of the recess 28 into contact with the fork 19 and percussively imparts to the latter a transverse closing up which enables it to slide into the housing 29 so that the coupling 20 is re-engaged pending a new cycle of operation (see FIG. 2).

To eliminate longitudinal clearance in this coupling, failing which the sequence of successive closing of the switches could be degraded, an elastic plate 29' may advantageously be disposed in the housing 29 to impart a calibrated penetration and longitudinal clamping of the fork so that the two contact-holders have accurately defined relative positions.

The means that have just been described are fully effective only if the solenoid characteristic is carefully chosen so that the decelerations due to the expenditure of energy required to release the coupling 20 and to compress the spring 12' are not too great.

What is more, the energy provided by relaxation of the return spring 5 of the armature must be sufficient to insert the fork into the housing however the device may be oriented in space.

In a second embodiment of the releasable coupling 40 shown in FIG. 5 the two contact-holders 38, 39 are associated with each other by virtue of the adhesion of a magnetised part 37 and a magnetisable part 36 respectively of a ferrite and soft iron, for example.

To meet specific manufacturing requirements and to reduce technology costs, the magnetisable part and the permanent magnet could be on either contact-holder.

It is essential to guarantee a consistent coupling force from one operation to the next. At least one of the parts 36, 37 may be enabled to orient itself, for example by using elastomer materials to hold them or by fixing them to moulded and articulated portions of the contact-holder(s).

Finally, it is clear that the unoperated positions of the two contact-holders are sufficiently close together to avoid material contact with the permanent magnets whilst ensuring sufficient proximity for automatic magnetic coupling.

The positions of the abutment surfaces which are necessary for the separation of the magnetic and magnetisable parts when the solenoid is energised are governed by considerations similar to those applying to the mechanical coupling.

Other types of releasable coupling may be substituted for those which have just been described.

We claim:

1. Switch device comprising at least one main switch adapted to change from an open condition to a closed condition during a transient closing phase and from a closed condition to an open condition during a transient opening phase, said two phases being caused by respective displacements of an operating member, and at least one auxiliary switch comprising at least one fixed contact and one mobile contact coupled to said operating member by a mechanixal linkage, comprising a releasable coupling adapted to change from a coupled condition to an uncoupled condition during one of said transient phases and to return thereafter from said uncoupled condition to said coupled condition during subsequent passage of the main switch through the other transient phase, wherein said releasable coupling is of the stress-release type and is adapted to be released when an operating force transmitted to the auxiliary switch by the operating member of the main switch exceeds a predetermined threshold.

2. Switch device according to claim 1, wherein the mobile contact of the auxiliary switch is mobile between two positions, namely: an open position and a closed position, and said mobile contact is urged towards one of said positions by elastic means.

3. Switch device according to claim 1, wherein said releasable coupling comprises elastic snap-fastener means.

4. Switch device according to claim 1, wherein said releasable coupling comprises two magnetically coupled parts, one of the two parts being coupled to the operating member of the main switch and the other part being coupled to the mobile contact of the auxiliary switch.

5. Switch device according to claim 1, wherein said switches are disposed in a common casing, said operating member being displaced manually.

6. Switch device according to claim 1, wherein the main switch and the auxiliary switch are multipole switches and wherein said mechanical linkage comprising the releasable coupling links the mobile assemblies of the two switches.

7. Switch device according to claim 1, wherein said main switch is part of a contactor whose solenoid is coupled to said operating member.

8. Switch device according to claim 6, wherein said contactor is housed in a first casing and the auxiliary switch is housed in a second casing that can be mechanically associated with the first casing.

9. Switch device according to claim 1, wherein the main switch controls the supply of power to a capacitive load and the auxiliary switch is connected in parallel with the main switch to supply power to the load through limiter resistors in a time period preceding closing of the main switch and wherein the releasable coupling is adapted to be released during the closing phase of the main switch, the auxiliary switch going to a closed condition before the main switch to supply the load initially and then returning to an open condition, following release, after the main switch is closed.

* * * * *